US005335027A

United States Patent [19]

Lin et al.

[11] Patent Number: 5,335,027

[45] Date of Patent: Aug. 2, 1994

[54] TRANSPARENCY FOLDER

[76] Inventors: Fong-Ing Lin, 5 Fl. No. 2, Lane 62, Sec. 1, Chung Cheng Rd., Tan Shui Jen, Taipei Hsien; Sheau-Wen Lin, 3 Fl., No. 21, Lane 16, Tzu Yu Rd., Hsinchu City, both of Taiwan

[21] Appl. No.: 98,634

[22] Filed: Jul. 28, 1993

[51] Int. Cl.[5] ..... B65D 27/00

[52] U.S. Cl. ..... 353/120; 40/159

[58] Field of Search ..... 353/120, DIG. 3; 40/366, 362, 159, 158.1, 159.2, 155

[56] References Cited

U.S. PATENT DOCUMENTS

| | | | |
|---|---|---|---|
| 4,247,999 | 2/1981 | Latino | 40/159 |
| 4,402,585 | 9/1983 | Gardlund | 353/120 |
| 4,771,557 | 9/1988 | Bowman | 40/159 |
| 4,925,720 | 5/1990 | Hauser | 40/159 |

*Primary Examiner*—William A. Cuchlinski, Jr.
*Assistant Examiner*—William C. Dowling
*Attorney, Agent, or Firm*—W. Wayne Liauh

[57] ABSTRACT

A transparency folder, which has an index region for inserting an stripe index therein to facilitate locating a specific transparency, an opaque contrast sheet to facilitate quickly identifying the contents of a transparency; the whole transparency folder can provide a transparency with projection and identifi-cation functions.

10 Claims, 3 Drawing Sheets

TRANSPARENCY FOLDER

BACKGROUND OF THE INVENTION

In order to overcome the electrostatic effect of a transparency sheet, a transparent folder is usually used for transparency; such folder can also provide a transparency with a protection and a storage functions; however, such conventional folder still has the drawbacks as follows:

1. Having no index indicator and the user having difficulty to pick up a transparency required quickly.

2. Having no background sheet, and the user having difficulty to find a specific transparency under a poor light condition.

SUMMARY OF THE INVENTION

This invention relates to a transparency folder, which comprises a transparent plastic folder and an opaque contrast sheet; the upper end of the transparent plastic folder has an opening; the side and bottom edge of the transparent plastic folder have seal edges respectively. The side edge of the opaque contrast sheet also has a seal edge. The transparent plastic folder and the opaque contrast sheet are glued together by means of a sealing method to form into a binding part and two index regions with thumb index notches. A transparency can be put in the transparent plastic folder for protection after the opaque contrast sheet be turned and preventing from electrostatic effect. The opaque contrast sheet can be used to indicate the contents of the transparency easily under the poor light condition; a specific transparency can be picked up by means of the index stripes.

DETAILED DESCRIPTION

Figure 2:
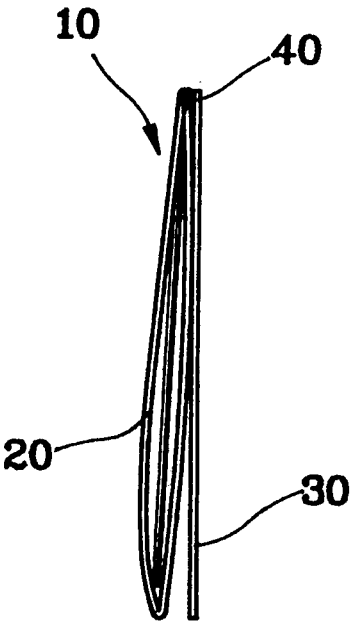
FIG. 2 is a top view of embodiment-1 of the present invention.
Figure 1:
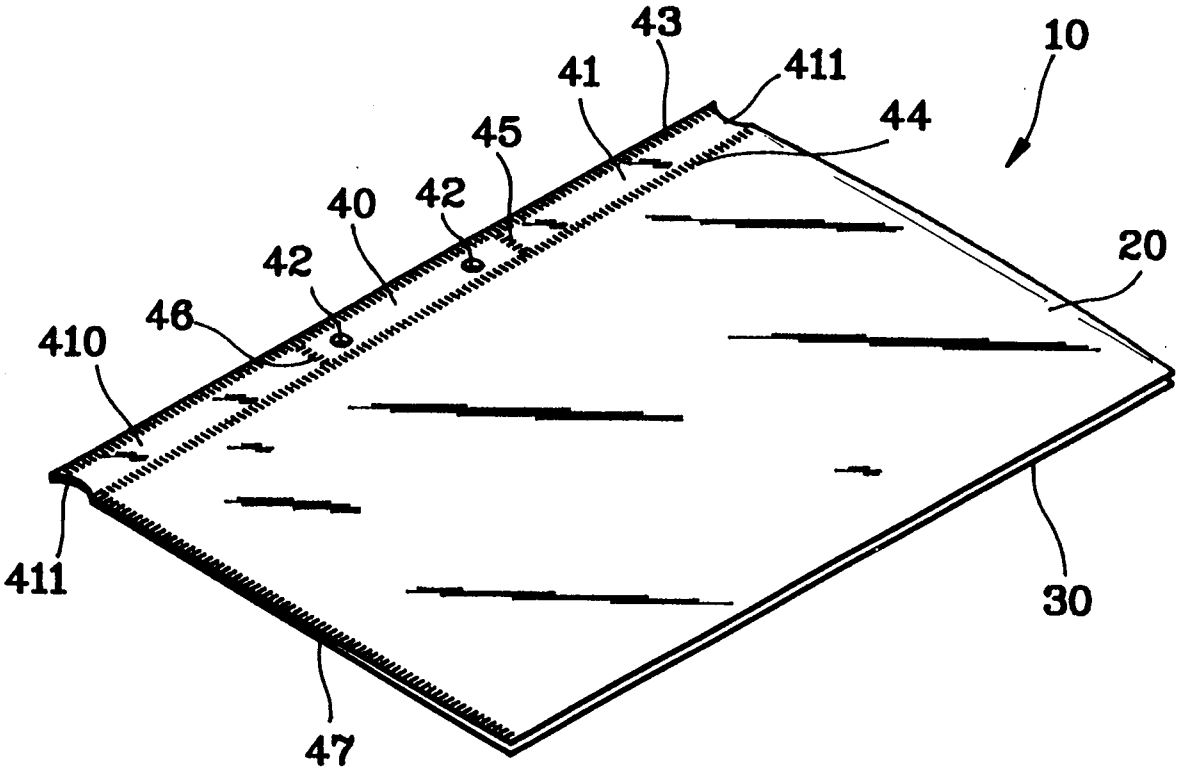
FIG. 1 is a perspective view of an embodiment-1 according to the present invention.
Figure 3B:
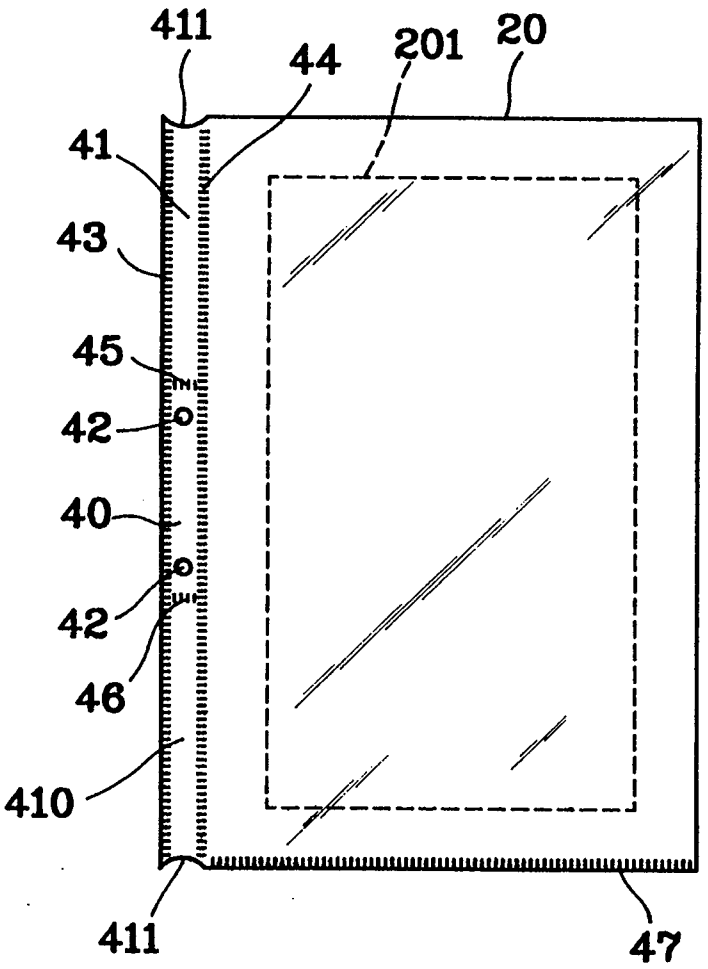
FIG. 3B is a front view of embodiment-2 of the transparent plastic folder according to the present invention.
Figure 3A:
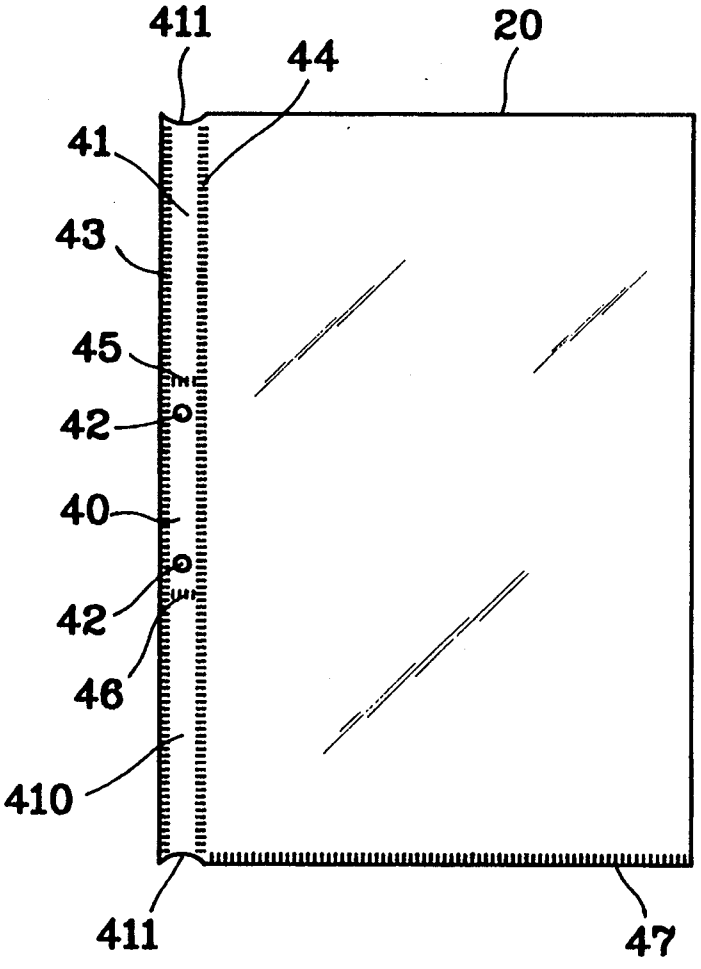
FIG. 3A is a front view of the transparent plastic folder according to embodiment-1 of the present invention.

Referring to FIGS. 1 and 2 the embodiment-1 according to the present invention is shown with a perspective view and a top view respectively, in which the transparency folder 10 comprises a transparent plastic folder 20 having a top sheet and a bottom sheet, and an opaque contrast sheet 30. The transparent plastic folder 20 includes an upper opening formed with two sheets, a first seal edge 43 and a second seal edge 44; between the first seal edge 43 and the second seal edge 44, there are a binding part 40 and two index regions 41 and 410, The binding part 40 is located between the two index parts 41 and 410 for mounting a binding fastener. The binding part 40 is defined with a third seal edge 45 and a fourth seal edge 46 so as to separate such part 40 from the index regions 41 and 410, The binding part 40 has two binding holes 42. The opening ends of the two index regions 41 and 410 are furnished with two curved or V-shaped thumb index notches 411 respectively. The lower side of the transparent plastic folder 20 has a fifth seal edge 47.

Figure 4B:
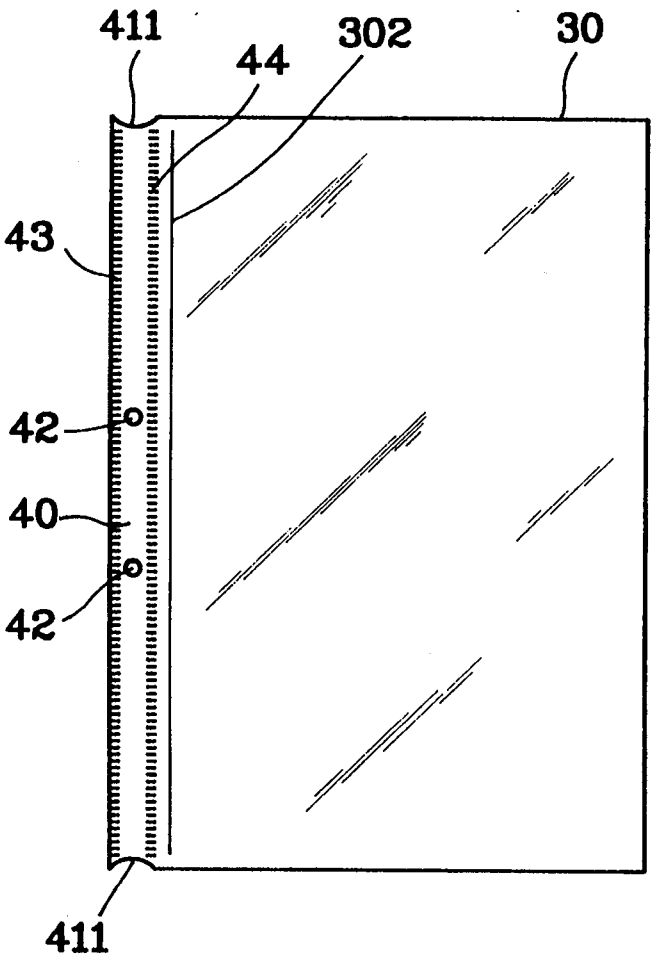
FIG. 4B is a front view of an opaque plastic base sheet of embodiment-3 according to the present invention.
Figure 4A:
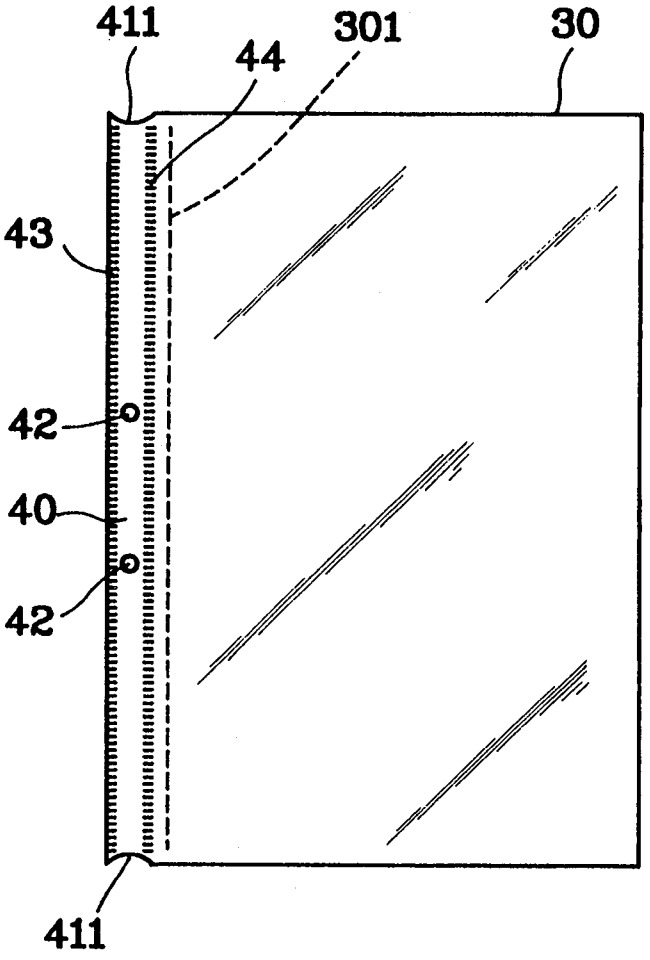
FIG. 4A is a front view of an opaque plastic base sheet of embodiment-1 according to the present invention.

The opaque contrast sheet 30 (as shown in FIG. 4-1) is a single sheet with color, and one edge on the side edge thereof has two parallel seal edges 43 and 44; a binding part 40 is formed between the first and second seal edges 43 and 44; the binding part 40 has two binding holes 42, and two curved or V-shaped thumb index notches 411 on the top and bottom ends thereof. A dotted folding line 301 is furnished in parallel with the second seal edge 44; the dotted folding line 301 may be replaced with a pressed folding line 302 (as shown in FIG, 4-2). FIG, 3-2 is a front view of embodiment-2 of the trans-parent plastic folder, which includes a top sheet and a bottom sheet; in order to increase the projection effect the bottom sheet is a transparent frame 201 (i.e., transparent plastic frame).

The opaque contrast sheet 30 is mounted behind the transparent plastic folder 20. The seal edges 43 and 44 are formed into shape by means of a thermal-press sealing method, then two thumb index notches 411, a binding part 40 and two index regions 41 and 410 are also formed into shade; at the same time, the fifth seal edge 47 on the bottom side of the transparent plastic folder 20 is also formed as shown in FIGS. 1 and 2. A transparency can be put in the transparent plastic folder 20 for proper projection after the opaque contrast sheet be turned and preventing from generating electrostatic effect. The opaque contrast sheet 30 under the transparent plastic holder 20 can be turned to indicate the contents of a transparency easily under the poor light condition. By means of the two index regions 41 and 410, an index indicator (such as a paper stripe) can be inserted in removed through the thumb index 411; in other words, the can provide a transparency with a proper protection and identification with index stripes.

We claim:

1. A transparency folder comprising a transparent plastic folder and an opaque contrast sheet; said transparent plastic folder including an opening on the top end thereof, and seal edges on the side edge and the bottom edge on the side edge thereof; said opaque contrast sheet having a seal edge on the side edge and a folding line, and said opaque contrast sheet being attached on the back of said transparent plastic folder; said transparent plastic folder and said opaque contrast sheet being attached together at one edge with a sealing method to form a binding part and two index regions, and a seal edge on the bottom edge of said transparent plastic folder.

2. A transparency folder as claimed in claim 1, wherein said opaque contrast sheet is a colored one.

3. A transparency folder as claimed in claim 1, wherein said opaque contrast sheet has a dotted folding line.

4. A transparency folder as claimed in claim 1, wherein said opaque contrast sheet has a pressed folding line.

5. A transparency folder as claimed in claim 1, wherein said binding part has several binding holes for mounting binding fasteners.

6. A transparency folder as claimed in claim 1, wherein both the upper and the lower ends of said binding part have index region with thumb index notches respectively.

7. A transparency folder as claimed in claim 6, wherein said thumb index notches are in a curved shape.

8. A transparency folder as claimed in claim 6, wherein said thumb index notches are in V-shape.

9. A transparency folder as claimed in claim 1, wherein said seal edges are sealed with a thermal-press sealing method.

10. A transparency folder as claimed in claim 1, wherein said transparent plastic folder includes a top sheet and a bottom sheet; said bottom sheet being a transparent frame.

* * * * *